United States Patent [19]

Ye

[11] Patent Number: 4,518,082

[45] Date of Patent: May 21, 1985

[54] DEVICE FOR TEMPORARILY ISOLATING AN ADDITIVE IN A BEVERAGE CONTAINER

[76] Inventor: Shem D. Ye, Yen Cheng District, Kaohsiung City, Taiwan

[21] Appl. No.: 568,362

[22] Filed: Jan. 5, 1984

[51] Int. Cl.[3] ..... B65D 77/04

[52] U.S. Cl. ..... 206/217; 206/0.5; 206/568; 426/115; 426/124

[58] Field of Search ..... 99/323; 206/0.5, 568, 206/216–219; 215/1 A; 220/90.2, 90.4; 222/4, 188, 491, 493, 544; 229/7 S; 239/16, 24, 33, 34, 39, 337, 373, 533.1, 533.15, 662; 426/77, 85, 86, 112, 115, 116, 118, 120, 124, 131

[56] References Cited

U.S. PATENT DOCUMENTS

| | | | |
|---|---|---|---|
| 2,102,920 | 12/1937 | Savage | 426/85 |
| 2,294,224 | 8/1942 | Daly | 239/33 |
| 2,900,100 | 8/1959 | Debat et al. | 206/219 |
| 2,948,453 | 8/1960 | Drown | 215/1 A |
| 3,099,565 | 7/1963 | Neuhauser | 426/85 |
| 3,275,448 | 9/1966 | Sommer | 426/115 |
| 3,620,759 | 11/1971 | Maddox | 206/0.5 |
| 4,387,809 | 6/1983 | Botzler | 206/219 |
| 4,399,158 | 8/1983 | Bardsley | 206/219 |

*Primary Examiner*—George E. Lowrance
*Assistant Examiner*—Jimmy G. Foster
*Attorney, Agent, or Firm*—Birch, Stewart, Kolasch & Birch

[57] ABSTRACT

In a tight beverage container, a device for isolating an additive from a beverage comprises a tube having a closed end and an open end for receiving an additive. A hole is provided at the closed end of the tube and is blocked up with an edible and water soluble solid when the additive is introduced into the tube. A mass is further provided in the closed end so as to direct said closed end downward when the tube is suspended in the beverage container.

2 Claims, 2 Drawing Figures

DEVICE FOR TEMPORARILY ISOLATING AN ADDITIVE IN A BEVERAGE CONTAINER

This invention relates to a beverage container, particularly to a device adapted to be placed in a beverage container for temporarily isolating an additive from a beverage.

Salt is an important component in a human blood and is often lost from the human blood due to sweating during a strong bodily action. Therefore, sportmen usually add some salt in the beverage when they drink so as to restore the salt content.

Some beverages, for example, lemon juice plus water, can not maintain their original taste and odor after a period. This is because the water present in the beverage will alter the characteristic of the fruit juice and lead to the deterioration of the beverage. For this reason, some beverages can not be available as a canned or bottled beverage.

SUMMARY OF THE INVENTION

An object of the invention is to provide a bottled or canned beverage with a device for temporarily isolating an additive from the beverage and adding it to the beverage at the instant of opening the beverage can or bottle. With this device, additive, such as, salt can be added to the beverage container and beverages like lemon squash can be canned or bottled.

The foregoing and other objects can be achieved in accordance with the invention through the provision of a device which comprises a tube having a closed end and an open end for receiving an additive and a hole provided near said closed end, and a mass provided in said closed end so as to direct said closed end downward when said tube is located in a tight beverage container.

In accordance with the invention, a method for temporarily isolating an additive from a beverage which is packaged in a tight container comprises the steps: taking a tube having a closed end and an open end and having a hole near said closed end; placing a mass into said tube and blocking said hole with an edible and water soluble solid; introducing an additive into said tube; and locating said tube in said tight container.

The presently preferred exemplary embodiment will be described in detail with reference to the following drawings, wherein:

DETAILED DESCRIPTION OF THE PREFERRED EMBODIMENT

Figure 2:
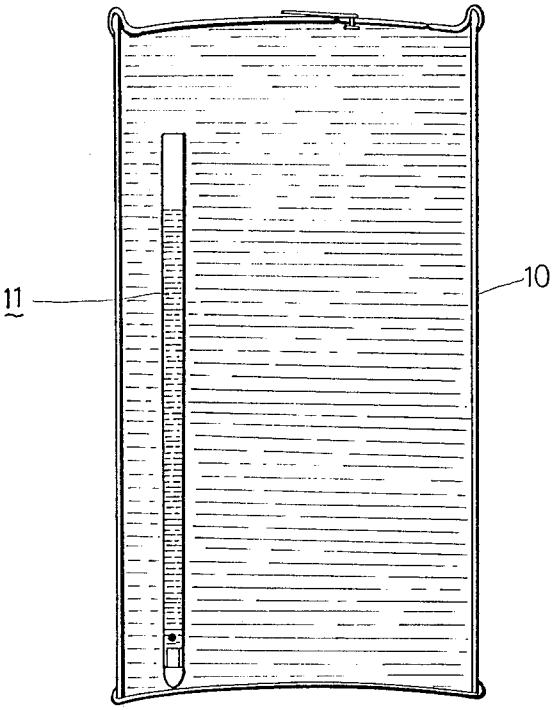
FIG. 2 is a beverage container which is provided with a device for isolating an additive from a beverage.
Figure 1:
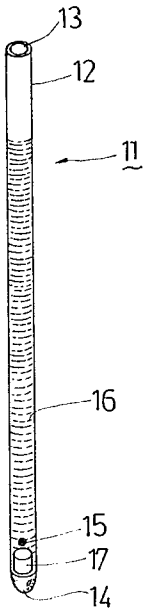
FIG. 1 is a view of a device for isolating an additive from a beverage.

Referring to the drawings, there is shown a beverage can 10 in which is suspended a device 11 for isolating an additive from the beverage. The device 11 includes a tube 12 which has an open end 13 and a closed end 14 and has a hole 15 provided near the closed end 14. The hole 15 is blocked up with an edible and water soluble solid, such as, sugar crystal, salt crystal and then a viscous additive 16 is introduced into the tube 12.

At the closed end of the tube is further provided with a weighing mass 17 so that the closed end of the tube 12 is directed downward. Although the solid blocking the hole 15 gradually dissolves in the water, the additive provided in the tube 12 does not flow out when the can is closed. This is because the pressure in the can is uniform throughout the pressurized liquid. When the can is opened, the pressure in the can is released and the additive 16 escapes from the tube 12 and diffuses into the liquid in the can.

It can be noted that the beverage container constructed according to the invention is not only convenient for use and the additive in the tube 12 can be controllably added to the beverage.

With the invention thus explained, it is apparent that obvious modifications and variations can be made without departing from the scope of the invention. It is therefore intended that the invention be limited only as indicated in the appended claims.

I claim:

1. In a tight beverage container, a device for temporarily isolating an additive from a beverage comprising: a tube having a closed end and an open end for receiving an additive and a hole provided near said closed end; and a mass provided in said closed end so as to direct said closed end downward when said tube is suspended in the beverage container.

2. A method for isolating an additive from a beverage which is packaged in a tight container comprising the steps:

taking a tube having a closed end and an open end and having a hole near said closed end;

placing a weighting mass into said closed end and blocking said hole with an edible and water soluble solid;

introducing an additive into said tube; and locating said tube in said tight container.

* * * * *